United States Patent [19]

Holopainen

[11] 3,983,791

[45] Oct. 5, 1976

[54] CONTROL HANDLE

[76] Inventor: Vaino J. Holopainen, P.O. Box 49, East Sullivan, N.H. 03445

[22] Filed: June 17, 1974

[21] Appl. No.: 479,824

[52] U.S. Cl. ..... 91/466; 137/625.69

[51] Int. Cl.[2] ..... F15B 11/08; F15B 13/04

[58] Field of Search ..... 74/548, 543; 137/625.69, 625.68, 625.67; 251/231, 64, 514, 236, 243; 91/418, 462, 469, 466

[56] References Cited

UNITED STATES PATENTS

| | | | |
|---|---|---|---|
| 508,525 | 11/1893 | Parke | 251/243 |
| 2,295,948 | 9/1948 | Henry | 137/625.69 X |
| 2,610,022 | 9/1952 | Meddock | 137/625.69 |
| 3,221,770 | 12/1965 | Faisandier | 91/466 X |

FOREIGN PATENTS OR APPLICATIONS

| | | | |
|---|---|---|---|
| 412,663 | 7/1934 | United Kingdom | 74/548 |

*Primary Examiner*—Irwin C. Cohen

*Attorney, Agent, or Firm*—Norman S. Blodgett; Gerry A. Blodgett

[57] ABSTRACT

Control system including an hydraulic valve and cylinder and including apparatus for indicating to the operator the exact point when pressure fluid starts to flow to the cylinder.

1 Claim, 1 Drawing Figure

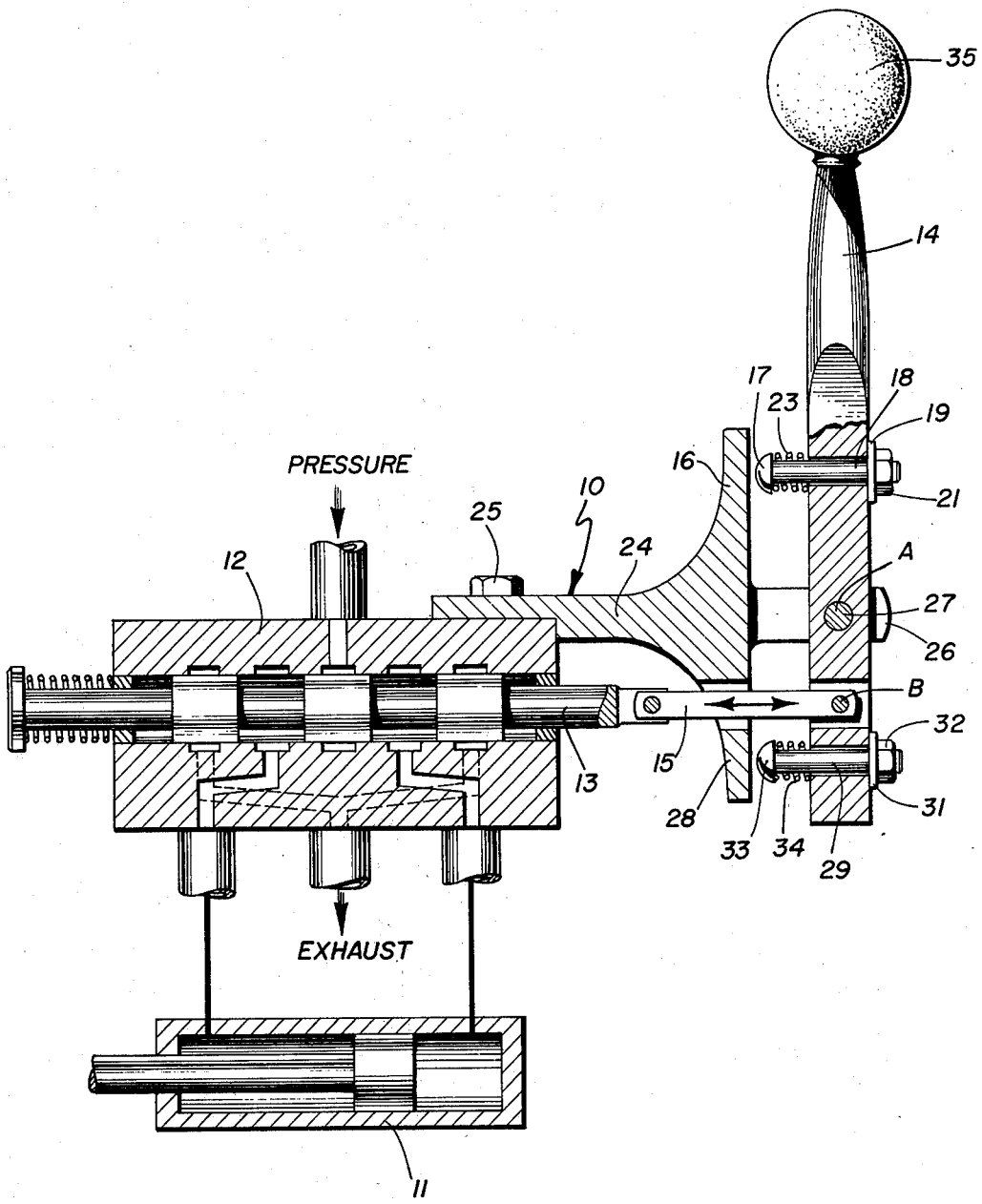
35
14
17
23
18
19
16
21
PRESSURE
10
25
24
A
12
27
26
B
32
15
13
28
31
33
34
29
EXHAUST
11

CONTROL HANDLE

BACKGROUND OF THE INVENTION

In the operation of hydraulic equipment and, particularly, earth moving and excavating apparatus, the operator is faced with a peculiar problem. When he moves the operating handle of the valve which controls the flow of pressure fluid to the cylinder being operated, the valve suddenly opens in the intermediate part of the handle stroke. This causes the fluid to flow to the cylinder suddenly and to begin operation of the apparatus with a jerk. Furthermore, if he tries to hold the handle with the valve slightly open to permit slow movement of the apparatus, or even for the purpose of jogging the apparatus, he is faced with the fact that the vehicle on which the apparatus is mounted may be traveling over rough terrain. Similarly, even if the vehicle is in a fixed position adjacent an excavation, for instance, the erratic forces to which the apparatus is being subjected as it moves through earth and rock causes the operator to be so moved about on the vehicle, so that it is difficult for him to maintain the handle in a fixed position relative to the valve. The result of this motion of the operator in the vehicle and the difficulty in holding the handle fixed relative to the valve, is that the operation of the cylinder and of the excavation apparatus is erratic, so that not only is the operation carried on in less than a smooth manner, but the entire hydraulic system is being subjected to force and pressure changes that cause more wear than is necessary. These and other difficulties experienced with the prior art devices have been obviated in a novel manner by the present invention.

It is, therefore, an outstanding object of the invention to provide a control system which permits an operator to regulate a hydraulic cylinder to operate smoothly despite jarring of the vehicle in which he is seated.

A further object of the present invention is the provision of a control apparatus for a hydraulic actuator that eliminates erratic behavior of the apparatus for reasons not connected with the work being performed.

It is another object of the instant invention to provide a control system for providing an operator with a strong indication of the point in valve motion when flow of pressure fluid begins to take place to a hydraulically operated apparatus.

A still further object of the invention is the provision of a control system including apparatus to permit an operator to control hydraulically-actuated apparatus smoothly despite the movement of the vehicle to which the apparatus is attached moving over rough terrain.

It is a further object of the invention to provide a control system associated with hydraulically-actuated apparatus permitting an operator to select and maintain the flow of fluid to a cylinder at a selected amount.

It is a still further object of the present invention to provide a control system including sensing apparatus that can readily be applied to pre-existing equipment.

Another object of the invention is the provision of a control system including sensing apparatus that is rugged in construction, relatively simple to manufacture, and which is capable of a long life of useful service with a minimum of maintenance even in dusty conditions.

With these and other objects in view, as will be apparent to those skilled in the art, the invention resides in the combination of parts set forth in the specification and covered by the claims appended hereto.

SUMMARY OF THE INVENTION

In general, the invention consists of a control system having a hydraulic cylinder, having a valve connected to the cylinder for directing pressure fluid thereto, the valve having a longitudinally-slidable plunger, and having a lever mounted for pivotal motion relative to the valve about an axis. A link joins the plunger to a point on the lever spaced a substantial distance from the said axis.

A stop is fixedly related to the valve and a contact element is mounted on the lever at a point spaced a substantial distance from the said axis and is adapted to engage the said stop at a point in the pivotal motion, while allowing pivotal motion passed that point despite such engagement.

More specifically, the contact element consists of a pin mounted in the lever for sliding motion transversely thereof, the pin having a washer at one side of the lever to limit the motion in the direction toward the stop. The pin has a head on the other end for engagement with the stop and a coil spring lies around the pin and is maintained under compression between the said head and the adjacent side of the lever.

BRIEF DESCRIPTION OF THE DRAWINGS

The character of the invention, however, may be best understood by reference to one of its structural forms, as illustrated by the accompanying drawings, in which;

The single FIGURE of drawing shows a control system constructed in accordance with the principles of the present invention.

DESCRIPTION OF THE PREFERRED EMBODIMENT

Referring to the drawing, it can be seen that the control sytem indicated generally by the reference numeral 10, contains a hydraulic cylinder 11 which is connected by suitable conduits to a valve 12, having a longitudinally slidable plunger 13. A lever 14 is mounted for pivotal movement relative to the valve about an axis A, while a link 15 joins the plunger 13 to the lever 14 at a point B spaced a substantial distance from the said axis A. A stop element 16 is fixed rigidly relative to the body of the valve 12 and of the pivotal axis A. A contact element 17 is mounted on the lever 14 at a point spaced a substantial distance from the pivotal axis A and is adapted to engage the stop element at a point in the pivotal motion, while allowing further pivotal motion passed that point despite such engagement.

It can be seen that the lever 14 is mounted as a first degree lever with the axis A constituting the fulcrum and the link 15 acting as the load. The contact element 17 consists of a pin 18 slidably carried in the lever for motion transversely thereof and provided in one end with a washer 19 and a nut 21 engaging a threaded end of the pin. The other end of the pin is provided with a head 22 having a semi-spherical shape. Between the head and the side of the lever 14 lies a coil spring 23 which is slightly under compression, but which is capable of being compressed to a much greater extent.

The stop element 16 consists of a finger extending upwardly from a bracket 24, which is fastened to the housing of the valve 12 by means of a bolt 25. The bracket 24 has a horizontally extending fork 26 with one tine lying on either side of the lever 14 and a hinge pin 27 extending transversely through the lever to act as a hinge pin operating about the axis A. Another finger 28 extends downwardly from the bracket 24 and acts as a stop element in connection with a pin 29. This pin is capable of sliding motion through the lower end of the lever 14 and is provided at its outer side with a washer 31 and is threaded to receive a nut 32. The other end of the pin 29 is provided with a semi-spherical head 33 adapted to engage a vertical surface of the finger 28. A coil spring 34 lies between the head 33 and the facing surface of the lever 14. The upper end of the lever is provided with a hand grip 35, formed of a suitable elastomer plastic such as Teflon.

The operation of the invention will now be readily understood in view of the above description. It will be understood that the difficulty with the old arrangements was that as one rides in the vehicle and it bounces over the ground, it is very difficult to find the exact point where the plunger 13 is located within the valve 12 to start the motion of the cylinder 11 properly. It will be understood that the location of the head 17 on the pin 18 and the location of the head 33 on the pin 29 can be adjusted by use of the nut 21 and 32 respectively. When the operator grasps the hand grip 35 and presses it to the left in the drawing, this serves to draw the plunger 13 to the right which eventually will cause pressure fluid to pass to the left-hand end of the cylinder 11. The head 17 of the pin 18 has been adjusted so that as the handle is moved just as oil has started to flow through the passages in the valve to the left-hand end of the cylinder 11, the head 17 strikes the stop element 16. The operator feels this and he knows then that oil pressure has started. He then can press the handle slightly more to the left and produce full flow of oil or he can leave the handle in the position that it is where he can feel the head 17 engaging the stop element 16 and allow for slow motion of the cylinder or for jogging. In other words, when the head of the pin 18 strikes the stop element 16, the operator knows that he has reached a position where the plunger has just opened up the ports to allow the flow of oil to the cylinder. The reverse, of course, is true if the operator wishes the cylinder to receive pressure oil at the right-hand end, and of course connect the other end to exhaust. He moves the hand grip 35 and the lever 14 to the right (clockwise) and this moves the plunger 13 to the left. Eventually, the head 33 of the pin 29 engages the surface of the stop element or finger 28 and indicates to the operator that oil has just started to flow to the cylinder. In this way, the fact that the operator is being bounced around on the top of the vehicle, either by moving over rough terrain, or because the operating elements of the vehicle are cutting a non-homogeneous material, so that the forces vary from time to time does not prevent him from holding the flow of oil to the cylinder at a constant rate. The apparatus is inexpensive and can be applied as an accessory to existing equipment. It is simple in construction and quite rugged in design, so that it will not be made inoperational by dust and the like.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A control system, comprising a. a hydraulic motor having a forward port and a reverse port and adapted to move selectively in a forward direction and a reverse direction at a velocity dependent on the rate of delivery of pressure fluid to the motor, the direction of the motor depending on the port to which the pressure fluid is delivered, b. a valve connected to the motor to deliver pressure fluid to the motor, the valve having a housing and a plunger which is longitudinally slidable in the housing in a first or in a second direction from a neutral position in which no pressure fluid is delivered to the motor, motion in the first direction beyond the first zero flow position causing increasing flow of pressure fluid to the forward port, and motion in the second direction beyond a second zero flow position causing increasing flow of pressure fluid to the reverse port, c. a lever having a first end provided with a hand grip, a second end and an intermediate portion, means mounting the lever on the housing at a pivot point on the intermediate portion of the lever for pivotal motion about an axis through the pivot point, and the lever having a first contact point spaced from the pivot point between the pivot point and the first end of the lever, a second contact point spaced from the pivot point between the pivot point and the second end of the lever, and a connection point spaced from the pivot point, d. a means joining the plunger to the connection point of the lever in such a way that motion of the lever causes longitudinal motion of the plunger, e. a first contacting system having a first biasing means, a first element connected to the housing, and a second element connected to the first contact point on the lever, one of the elements being moveably connected to its respective housing or contact point, and biased toward the other by the first biasing means, the first and second elements of the first contacting system being positioned with respect to one another, so that physical contact between the elements occurs when movement of the lever causes the plunger to move a substantial distance in the first direction to a point beyond the first zero point, after which point movement of the lever to continue movement of the plunger in the first direction operates against the impediment of the first biasing element, f. a second contacting system having a second biasing means, a first element connected to the housing, and a second element connected to the second contact point on the lever, one of the elements being moveably connected to its respective housing or contact point, and biased toward the other by the second biasing means, the first and second elements of the second contacting system being positioned with respect to one another, so that physical contact between the elements occurs when movement of the lever causes the plunger to move a substantial distance in the second direction to a point beyond the second zero point, after which point movement of the lever to continue movement of the plunger in the second direction operates against the impediment of the second biasing element, g. bracket means connected to said housing and supporting said lever mounting means, said bracket means further supporting the first elements of both of said first and second contacting system on the same side of said lever.

* * * * *